US008931568B2

(12) United States Patent
McNamee

(10) Patent No.: US 8,931,568 B2
(45) Date of Patent: Jan. 13, 2015

(54) SHUNT TUBE CONNECTIONS FOR WELLSCREEN ASSEMBLY

(71) Applicant: Weatherford/Lamb, Inc., Houston, TX (US)

(72) Inventor: Stephen McNamee, Rhode (IE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 14/175,152

(22) Filed: Feb. 7, 2014

(65) Prior Publication Data

US 2014/0262332 A1 Sep. 18, 2014

Related U.S. Application Data

(60) Provisional application No. 61/785,082, filed on Mar. 14, 2013.

(51) Int. Cl.
*E21B 19/16* (2006.01)
*E21B 43/08* (2006.01)
*E21B 43/04* (2006.01)

(52) U.S. Cl.
CPC ..... *E21B 43/08* (2013.01); *E21B 43/04* (2013.01)
USPC ..... 166/380; 166/77.51

(58) Field of Classification Search
USPC ..... 29/464, 428, 434, 436, 525.01; 285/18; 166/278, 378, 380, 77.51
See application file for complete search history.

(56) References Cited

U.S. PATENT DOCUMENTS

| | | | | |
|---|---|---|---|---|
| 5,341,880 | A | 8/1994 | Thorstensen et al. | |
| 5,390,966 | A * | 2/1995 | Cox et al. | 285/124.2 |
| 5,868,200 | A | 2/1999 | Bryant et al. | |
| 6,409,219 | B1 | 6/2002 | Broome et al. | |
| 7,497,267 | B2 | 3/2009 | Setterberg, Jr. et al. | |
| 2010/0059232 | A1 | 3/2010 | Langlais et al. | |
| 2010/0155064 | A1 | 6/2010 | Nutley et al. | |
| 2010/0236779 | A1 | 9/2010 | Nutley et al. | |

* cited by examiner

*Primary Examiner* — Kenneth L Thompson
*Assistant Examiner* — Ronald Runyan
(74) *Attorney, Agent, or Firm* — Wong, Cabello, Lutsch, Rutherford & Brucculeri LLP

(57) ABSTRACT

A well screen assembly has a base pipe and one or more screen sections attached to the outer surface of the base pipe. The assembly also has one or more shunt tubes attached to the base pipe via top and bottom rings. The shunt tubes can be attached to the screen sections via B-rings and may be transport tubes or packing tubes. Connections are used for securing a jumper tube to adjoining shunt tubes of adjoining screen sections of the wellscreen assembly, which may be used in open or cased holes. At a well site, the joints of the wellscreens have timed threads so that the various shunt tubes can be aligned with one another along the assembly as the joints are made up. The connections of the present disclosure allow operators to install a jumper tubes between shunt tubes at the joint without needing to tighten fasteners or assembly components.

28 Claims, 9 Drawing Sheets

200
220
222
240
250
236
247
240
14b 200
220
222
240
250
226
240
14b

G
15
250
222
240
226
247
220
222
226
230a
14a
G
15
250
222
226
240
14a
220
230b 200
220
225
226
230
H 240
242
247
250
252

230
232
234
235

530b
520b
510
516
514
512
518
535
522
524
520a
530a
540

SHUNT TUBE CONNECTIONS FOR WELLSCREEN ASSEMBLY

CROSS-REFERENCE TO RELATED APPLICATIONS

This application claims priority to U.S. Provisional App. 61/785,082, filed 14 Mar. 2013, which is incorporated herein by reference.

BACKGROUND OF THE DISCLOSURE

Production of hydrocarbons from loose, unconsolidated, and/or fractured formations often produces large volumes of particulates along with the formation fluids. These particulates can cause a variety of problems. For this reason, operators use gravel packing as a common technique for controlling the production of such particulates.

To gravel pack a completion, a screen is lowered on a workstring into the wellbore and is placed adjacent the subterranean formation. Particulate material, collectively referred to as "gravel," and a carrier fluid are pumped as a slurry down the workstring. Eventually, the slurry can exit through a "cross-over" into the wellbore annulus formed between the screen and the wellbore.

The carrier liquid in the slurry normally flows into the formation and/or through the screen itself. However, the screen is sized to prevent the gravel from flowing through the screen. This results in the gravel being deposited or "screened out" in the annulus between the screen and the wellbore to form a gravel-pack around the screen. The gravel, in turn, is sized so that it forms a permeable mass that allows produced fluids to flow through the mass and into the screen but blocks the flow of particulates into the screen.

Due to poor distribution, it is often difficult to completely pack the entire length of the wellbore annulus around the screen so that an interval in the annulus is not completely gravel packed. This poor distribution of gravel is often caused by the carrier liquid in the slurry being lost to the more permeable portions of the formation. Due to the loss of the carrier liquid, the gravel in the slurry forms "sand bridges" in the annulus before all of the gravel has been placed around the screen. Such bridges block further flow of the slurry through the annulus, thereby preventing the placement of sufficient gravel below the bridge in top-to-bottom packing operations or above the bridge in bottom-to-top packing operations.

Alternate flow conduits, called shunt tubes, can alleviate this bridging problem by providing a flow path for the slurry around such sand bridges. The shunt tubes are typically run along the length of the wellscreen and are attached to the screen by welds. Once the screen assemblies are joined, fluid continuity between the shunt tubes on adjacent screen assemblies must be provided, and several techniques have been developed to provide such continuity.

FIGS. 1A-1B are schematic views of examples of sand screens 18*a-b* provided with shunt tubes 30*a-b* in a wellscreen assembly 10. FIG. 2A illustrates an exploded view of the components for the wellscreen assembly 10 for use in an open hole. As an alternative, FIG. 2B illustrates an exploded view of components for the wellscreen assembly 10 for use in a cased hole.

In the assembly 10, a first sand control device 12*a* is coupled to a second sand control device 12*b*, and each device 12*a-b* has basepipe joints 14 joined together to define a production bore 16. Screens 18*a-b* having filter media surround the basepipe joints 14 and are supported by ribs 19. The assembly 10 is provided with shunt tubes 30*a-b*, which in this example are steel tubes having substantially rectangular cross-section. The shunt tubes 30*a-b* are supported on the exterior of the screens 18*a-b* and provide an alternate flow path 32 to the main production bore 16.

To provide fluid communication between the adjacent sand control devices 12*a-b*, jumper tubes 40 are disposed between the shunt tubes 30*a-b*. In this way, the shunt tubes 30*a-b* and the jumper tubes 40 maintain the flow path 32 outside the length of the assembly 10, even if the borehole's annular space B is bridged, for example, by a loss of integrity in a part of the formation F.

Additional examples of shunt tube arrangements can be found in U.S. Pat. Nos. 4,945,991 and 5,113,935. The shunt tubes may also be internal to the filter media, as described in U.S. Pat. Nos. 5,515,915 and 6,227,303.

As shown in FIGS. 1A-1B and 2A, the assembly for an open hole completion typically has main shrouds 28*a-b* that extend completely over the sand control devices 12*a-b* and provides a protective sleeve for the filter media and shunt tubes 30*a-b*. The shrouds 28*a-b* have apertures to allow for fluid flow. The main shrouds 28*a-b* terminate at the end rings 20*a-b*, which supports an end of the shroud 28*a-b* and have passages for the ends of the shunt tubes 30*a-b*. For a cased hole completion, the assembly 10 as shown in FIG. 2B may lack a shroud.

Either way, the shunt tubes 30*a-b* stop a certain length from the ends of the sand control devices 12*a-b* to allow handling room when the devices 12*a-b* are joined together at the rig. Once the devices 12*a-b* are joined, their respective shunt tubes 30*a-b* are linearly aligned, but there is a gap between them. Continuity of the shunt tubes' flow path 32 is typically established by installing the short, pre-sized jumper tubes 40 in the gap.

Each jumper tube 40 has a connector 50 at each end that contains a set of seals and is designed to slide onto the end of the jumper tube 40 in a telescoping engagement. When the jumper tube 40 is installed into the gap between the shunt tubes 30*a-b*, the connector 50 is driven partially off the end of the jumper tube 40 and onto the end of the shunt tube 30*a-b* until the connector 50 is in a sealing engagement with both shunt tubes 30*a-b* and the jumper tube 40. The shunt tubes' flow path 32 is established once both connectors 50 are in place. A series of set screws (not shown) can engage both the jumper tube 40 and adjoining shunt tube 30*a-b*. The screws are driven against the tube surfaces, providing a friction lock to secure the connector 50 in place.

This connection is not very secure, and there is concern that debris or protruding surfaces of the wellbore can dislodge the connectors 50 from sealing engagement with the tubes 30*a-b* and 40 while running the wellscreen assembly 10 into the wellbore. Therefore, a device called a split cover 22 as shown in FIG. 1A is typically used to protect the connectors 50. The split cover 22 is a piece of thin-gauge perforated tube, essentially the same diameter as the screen assembly 10, and the same length as the gap covered by the jumper tubes 40. The perforated cover 22 is spit into halves with longitudinal cuts, and the halves are rejoined with hinges along one seam and locking nut and bolt arrangements along the other seam. The split cover 22 can be opened, wrapped around the gap area between the sand control devices 12*a-b*, and then closed and secured with the locking bolts.

Other ways of connecting shunt tubes on adjoining sand control devices are known in the art. For example, U.S. Pat. No. 6,409,219 to Broome et al. describes a system wherein shunts on adjacent sand control devices are aligned when the correct torque is applied to join the devices. Alignment marks are included on the devices to indicate when the correct torque has been applied.

U.S. Pat. No. 5,341,880 to Thorstensen et al. describes a sand screen structure assembled from a plurality of generally tubular filter sections that are axially snapped together in a manner facilitating the simultaneous interconnection of circumferentially spaced series of axially extending shunt tubes secured to and passing internally through each of the filter sections. In an alternate embodiment of the sand screen structure, the shunt tubes are secured within external side surface recesses of the filter section bodies.

U.S. Pat. No. 5,868,200 to Bryant et al. describes an alternate-path wellscreen that is made-up of joints. The screen has a sleeve positioned between the ends of adjacent joints. The sleeve acts as a manifold for fluidly-connecting the alternate-paths on one joint with the alternate-paths on an adjacent joint.

Another connector is disclosed in U.S. Pat. No. 7,497,267, which is incorporated herein by reference. FIGS. 3A-3B show examples of connections 100*a-b* disclosed therein. The connections 100*a-b* secure a jumper tube 40 to a shunt tube 30. In general, the connections 100*a-b* are designed to slide onto the end of the jumper tube 40 in a telescoping engagement. When the jumper tube 40 is installed into the gap between the shunt tubes 30, the connections 100*a-b* are driven partially off of the end of the jumper tube 40 and onto the end of the shunt tube 30 to form a sealing engagement between both tubes 30 and 40. Lugs and set screws are then used to secure the connectors 100*a-b* in place.

For example, FIG. 3A shows a connection 100*a* having a connector 108 and a connector lock 102 disposed on a jumper tube 40. The jumper tube 40 has lugs 104 affixed to its sides. The connector 108 is pushed forward to engage a shunt tube 30 secured to the end ring 20. The connector lock 102 is the secured in place by screwing the screws 106 in the lock 102 to keep the lugs 104 in the side slots in the lock 102. The lugs 104 and screws 106 secure the lock 102 in the position to hold the connector 108 in the engaged position. As also shown in FIG. 3A, the connector 108 can include a sealing ring 109 to contact the shunt tube 30.

In another example, FIG. 3B shows a connection 100*b* having a connector 110 disposed on a jumper tube 40. A "C"-shaped receiver 112 is affixed to the shunt tube 30 and is positioned with the open side of the "C" toward the end of the tube 30. The connector 110 is moved to engage the shunt tube 30 so that the end of the connector 110 fits in the receiver 112. The connector 110 is attached to the jumper tube 40 with set screws 116, and other set screws 114 on the receiver 112 align with mating holes (not apparent in this view) in connector 110 to affix the tubes 30 and 40 together.

Although the above-techniques for connecting shunt tubes on adjoining joints of a wellscreen assembly may be effective, operators seek more efficient and reliable ways to make these connections at the rig during deployment of the assembly. The subject matter of the present disclosure is directed to overcoming, or at least reducing the effects of, one or more of the problems set forth above.

SUMMARY OF THE DISCLOSURE

A wellscreen assembly has first and second screen joints connected together and has first and second adjoining shunt tubes. The adjoining shunt tubes have opposed ends separated by a gap from one another. In one arrangement for making a connection between the adjoining shunt tubes, opposing components of the joints have first snap lock components disposed adjacent the opposed ends of the adjoining shunt tubes. A jumper tube having first and second ends positions in the gap between the opposed ends of the adjoining shunt tubes. Then, first and second end connectors are disposed on the ends of the jumper tube are moved thereon between from a retracted condition to an extended condition. Second snap lock components are disposed on the first end second end connectors. These second snap lock components engage the first snap lock components adjacent the opposed ends of the adjoining shunt tubes in a snap engagement and hold the jumper tube connected between the adjoining shunt tubes.

The opposing components can be end rings disposed on the connected wellscreen joints, or they can be third and fourth end connectors disposed on the opposed ends of the adjoining shunt tubes. The first snap lock components can be slots defined in the opposing components adjacent the opposed ends of the adjoining shunt tubes, and the second snap lock components can be tabs having catches engaging in the slots. Alternatively, the first snap lock components can be catches biased toward a locking position, and the second snap lock components can be slots engaging the biased catches in the locking position.

Preferably, the first and second end connectors are telescopically disposed on the first and second ends of the jumper tube, and each of the first and second connectors preferably has a seal engaging the jumper tube and the opposed end of the adjoining shunt tube.

In another arrangement for making a connection between the adjoining shunt tubes, a jumper tube has first and second ends and positions in the gap between the opposed ends of the adjoining shunt tubes. First and second end connectors disposed on the first and second ends of the jumper tube are moved thereon from a retracted condition to an extended condition. To do this, a linkage mechanism is connected to the first and second end connectors and is operable between first and second conditions. The linkage mechanism in the first condition retracts the first and second end connectors to the retracted condition from the first and second ends of the jumper tube. The linkage mechanism in the second condition extends the first and second end connectors to the extended condition from the first and second ends of the jumper tube and onto the opposed ends of the adjoining shunt tubes.

The linkage mechanism can include a plurality of linking arms connected together by pivots. One end of one of the linking arms is connected to the first end connector, and another end of the other of the linking arms is connected to the first end connector. Preferably, each of the first and second connectors comprises seals engaging the jumper tube and the opposed ends of the adjoining shunt tubes. Each of the first and second end connectors can be a tube section disposed externally on the end of the shunt tube. To keep the connectors on the opposed ends, a lock can lock the linkage mechanism in the second condition. The lock, for example, can be a band disposed about linking arms of the linkage mechanism.

To assemble the arrangement of the jumper tube between the opposed ends of the adjoining shunt tubes, operators position the jumper tube in the gap between the opposed ends of the adjoining shunt tubes on the connected wellscreen joints. The linkage mechanism is moved (e.g., pivoted) from a first condition to a second condition, and the first and second end connectors disposed on first and second ends of the jumper tube and connected to the linkage mechanism are moved from retracted conditions to extended conditions on the jumper tube. The first and second end connectors in the extended condition then engage with the opposed ends of the adjoining shunt tubes to complete the communication between the tubes. A lock can then be engaged.

The foregoing summary is not intended to summarize each potential embodiment or every aspect of the present disclosure.

DETAILED DESCRIPTION OF THE DISCLOSURE

Embodiments of a wellscreen assembly according to the present disclosure include basepipe joints and screen sections attached to the outer surface of the basepipe joints. The assembly also features shunt tubes attached to the basepipe joints via top and bottom end rings. The shunt tubes can be attached to the screen sections via B-rings and may be transport tubes or packing tubes for gravel packing operations or the like. Embodiments of the present disclosure provide connections for securing a jumper tube to adjoining shunt tubes of adjoining joints of the wellscreen assembly, which may be used in open or cased holes.

The connections of the present disclosure can be used on open-hole or cased-hole wellscreen assemblies. Cased hole assemblies may typically use centralizers disposed between wellscreen joints and may not have end rings at the various joints. As will be appreciated, the joints of the wellscreens assemblies have timed threads so that the various shunt tubes can be aligned with one another along the assembly as the joints are made up.

Figure 1A:
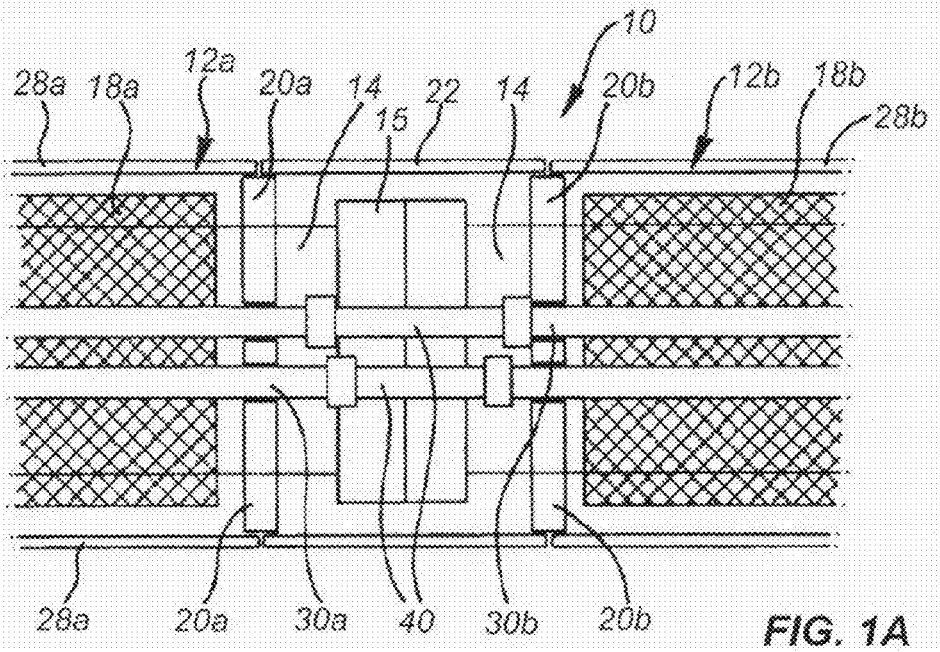
FIG. 1A (Prior Art)
FIG. 1A illustrates a side view of a wellscreen assembly according to the prior art for an open hole.
Figure 1B:
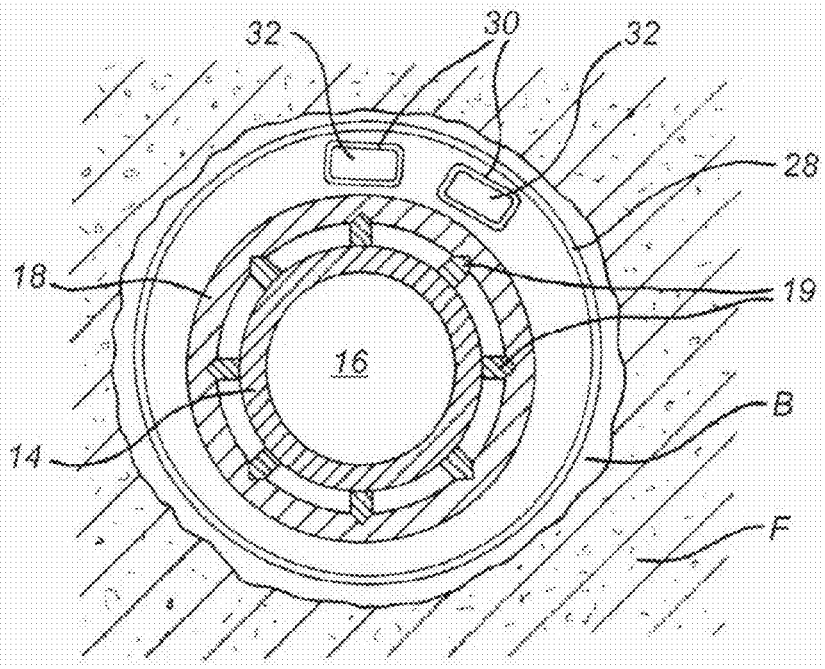
FIG. 1B (Prior Art)
FIG. 1B illustrates an end view of the open hole wellscreen assembly of FIG. 1A.
Figure 2A:
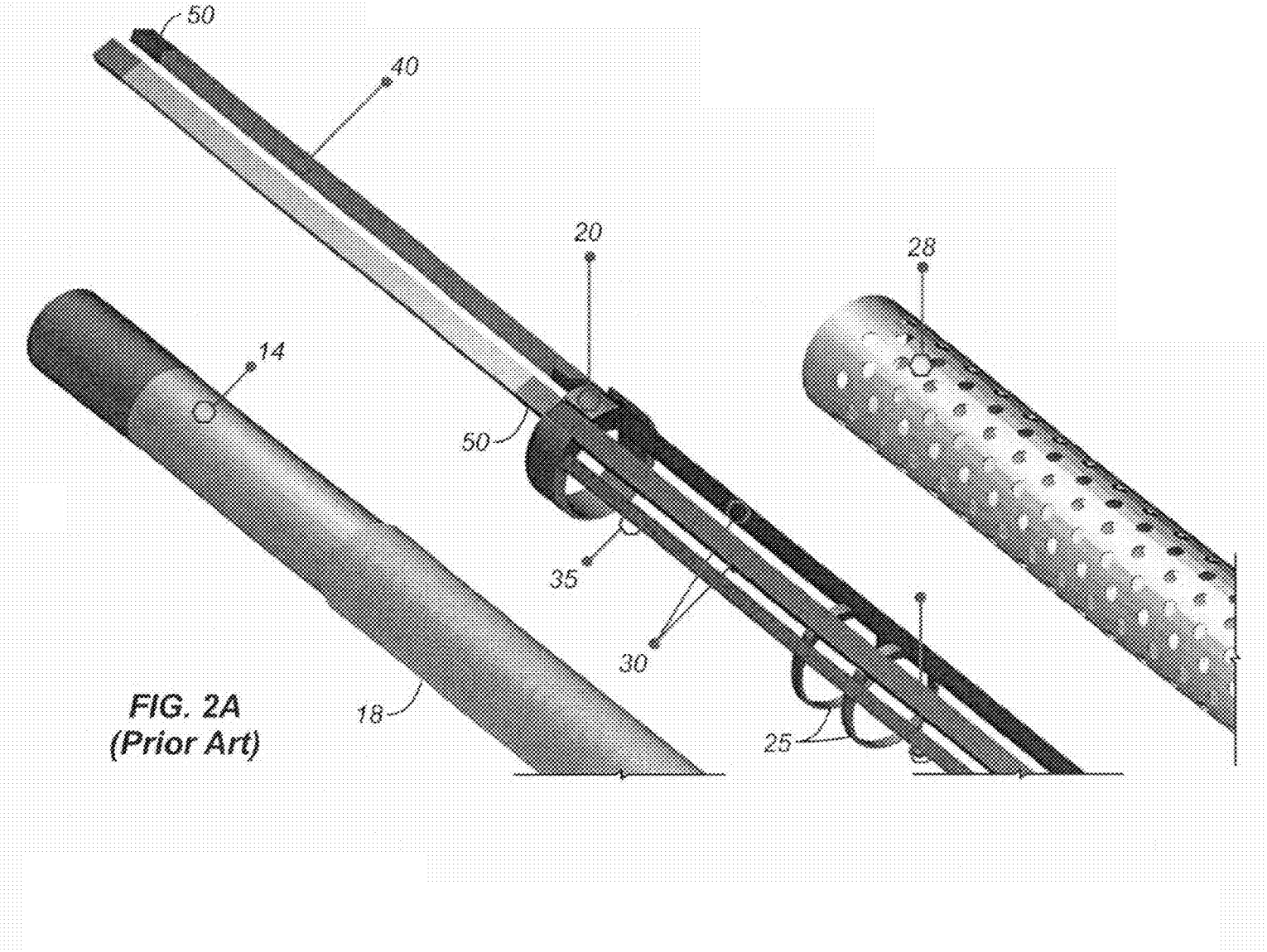
FIG. 2A (Prior Art)
FIG. 2A illustrates an exploded view of the components for the open hole wellscreen assembly of FIG. 1A.
Figure 2B:
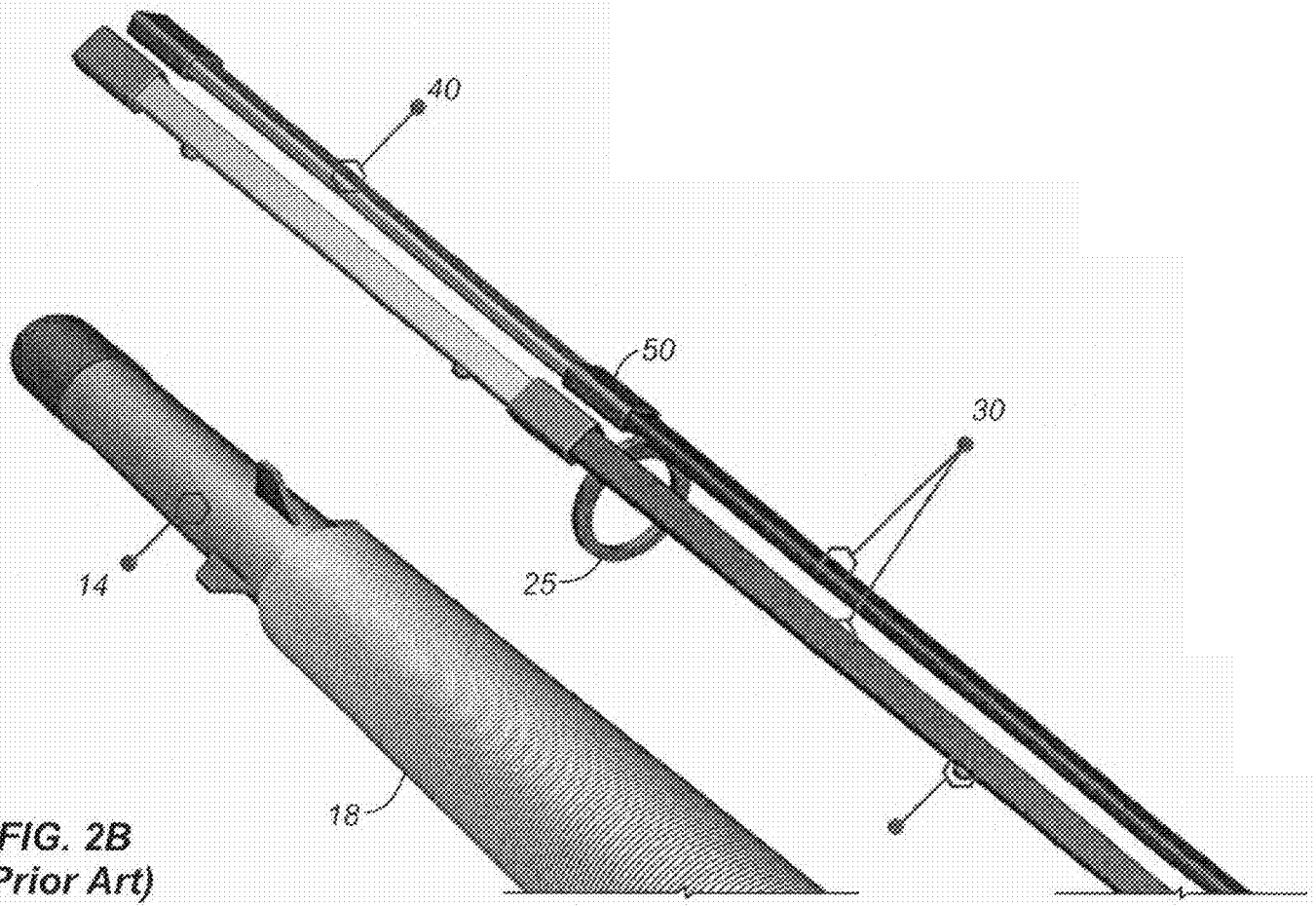
FIG. 2B (Prior Art)
FIG. 2B illustrates an exploded view of components for a cased hole wellscreen assembly.
Figure 3A:
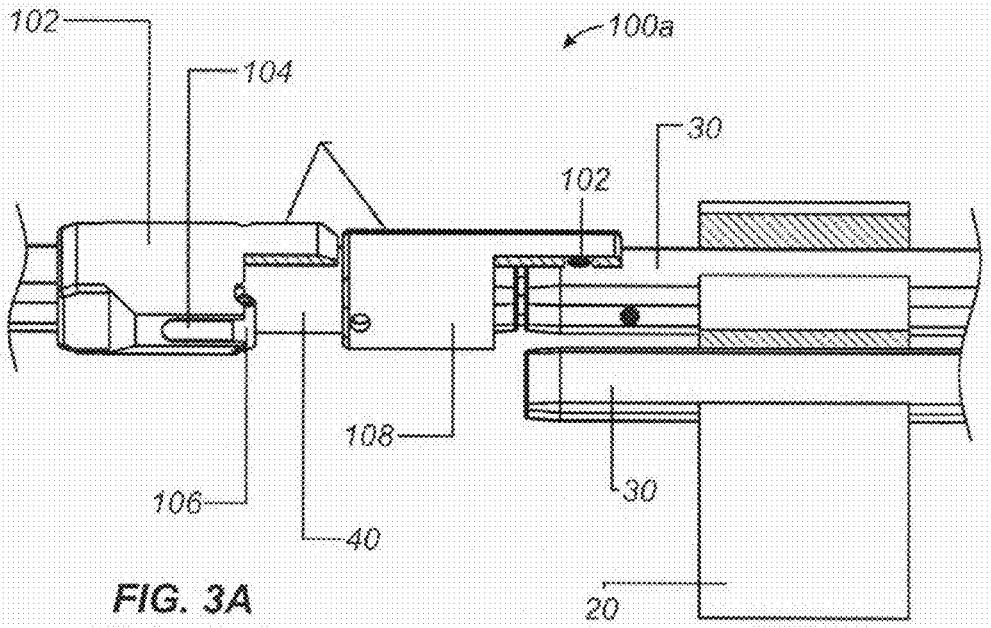
FIG. 3A (Prior Art)
FIG. 3A illustrates a side view of a prior art connector for shunt tubes of a wellscreen assembly.
Figure 3B:
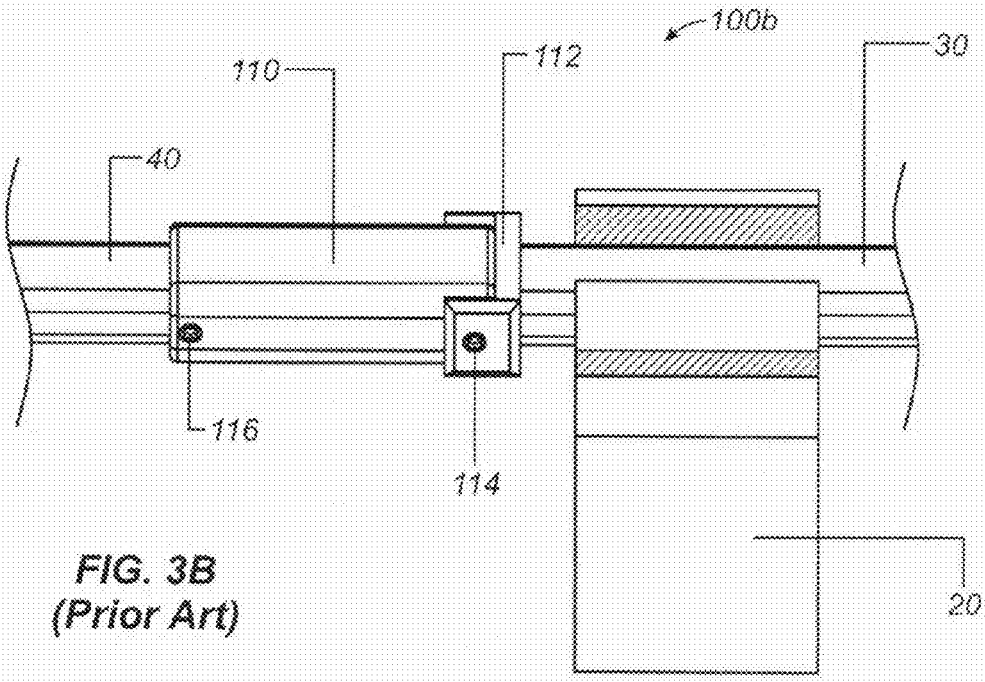
FIG. 3B (Prior Art)
FIG. 3B-3C illustrate side and perspective views of another prior art connector for shunt tubes of a wellscreen assembly.
Figure 3C:
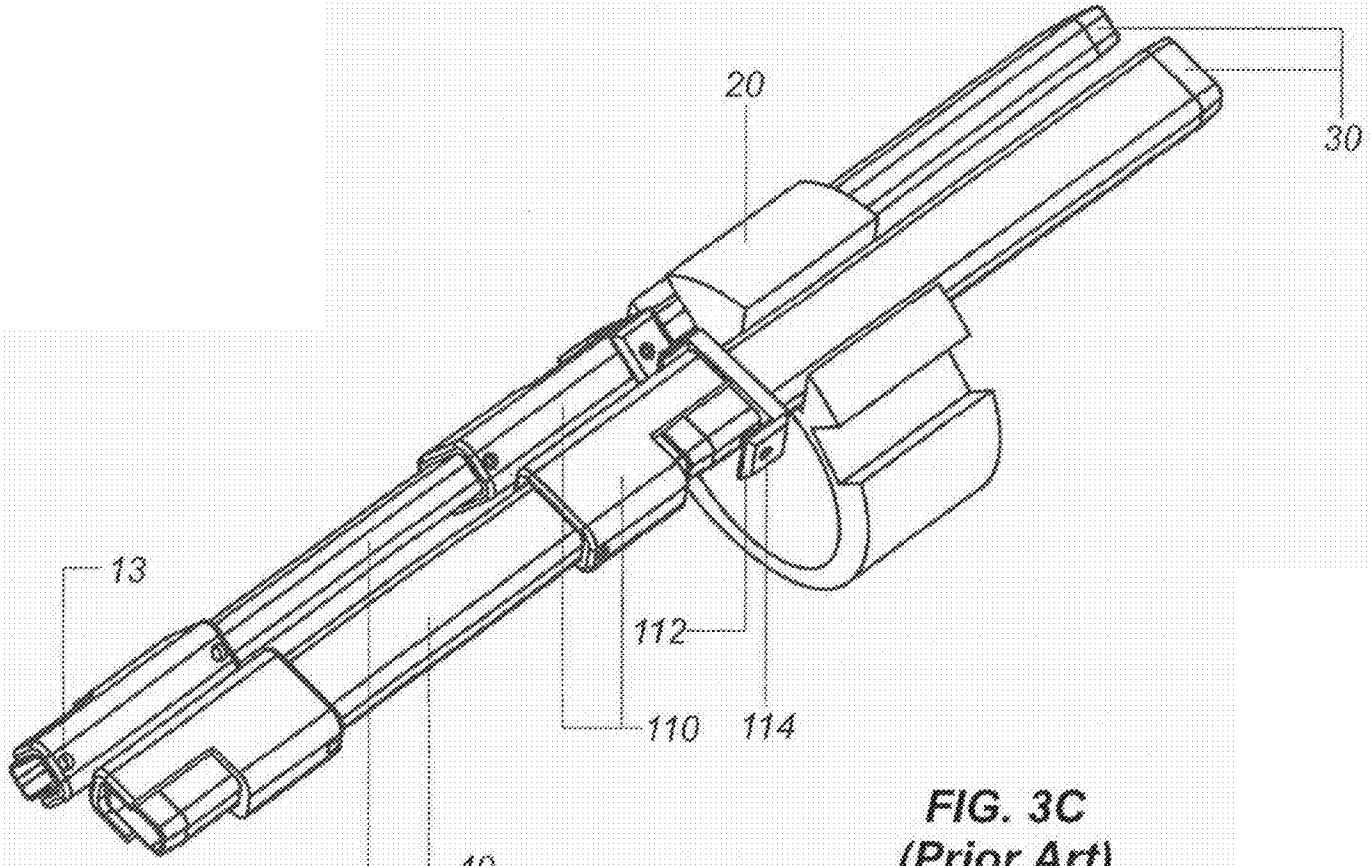
FIG. 3C (Prior Art)
Figures 4A, 4B:
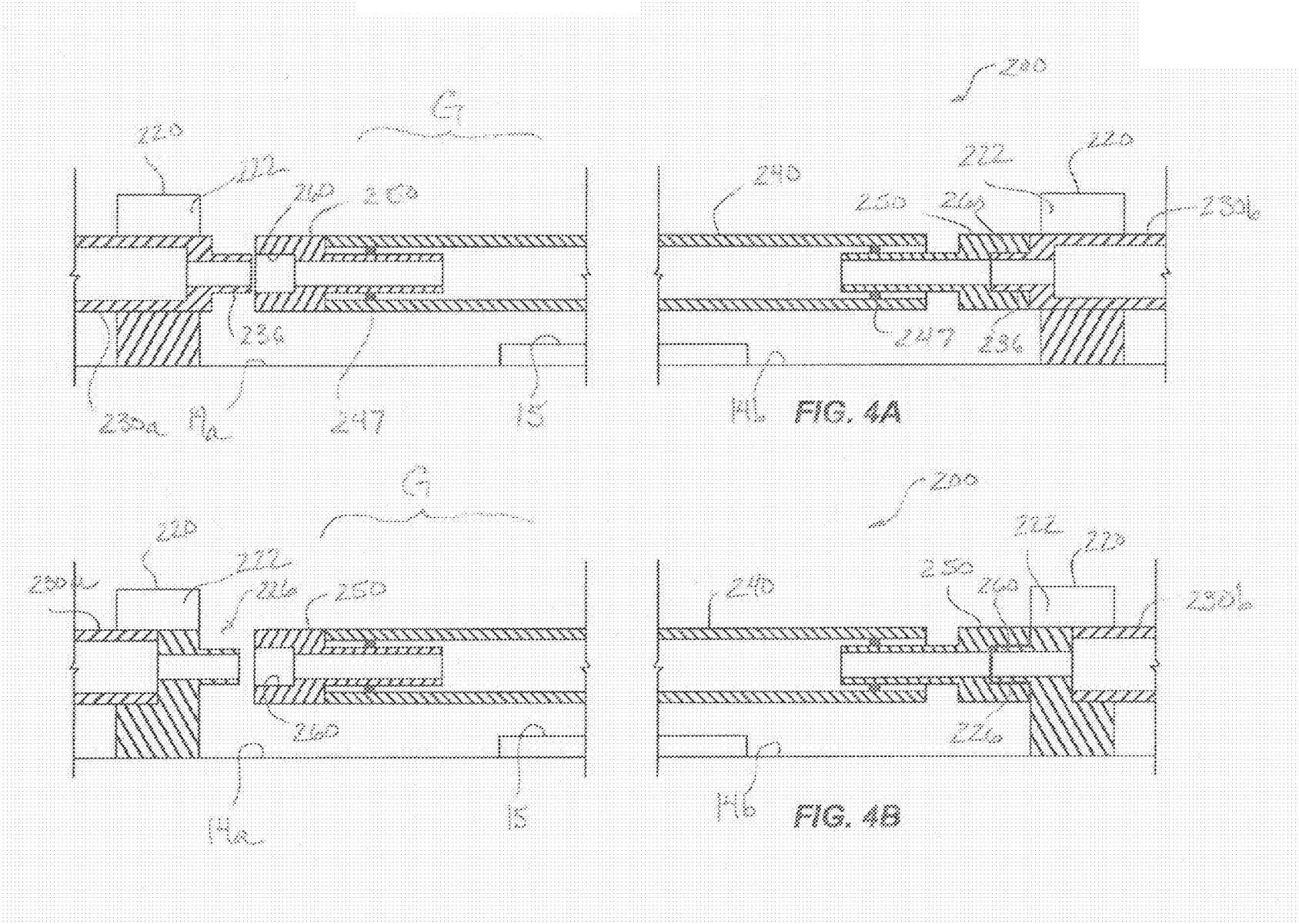
FIGS. 4A-4B illustrate arrangements of shunt tube connections according to the present disclosure for a wellscreen assembly.

Turning to FIGS. 4A-4B, a wellscreen assembly has first and second wellscreen joints 14*a-b* connected together at 15. The connected joints 14*a-b* have adjoining shunt tubes 230*a-b* with opposed ends separated by a gap G from one another. To make a connection 200 between the adjoining shunt tubes 230*a-b*, opposing components of the joints 14*a-b* have first snap lock components 236/226 adjacent the opposed ends of the adjoining shunt tubes 230*a-b*. In particular, the ends of the shunt tubes 230*a-b* in FIG. 4A can be the opposing components having the first snap lock components 236. By contrast, the end rings 220 of the joints 14*a-b* in FIG. 4B can be the opposing components having the first snap lock components 226. Alternatively, the assembly can use a combination of both of these configurations.

A jumper tube 240 having first and second ends positions in the gap G between the opposed ends of the adjoining shunt tubes 230*a-b*. First and second end connectors 250 are disposed on the ends of the jumper tube 240 and are movable thereon between extended and retracted conditions. Second snap lock components 260 are disposed on the first end second end connectors 250. These second snap lock components 260 engage the first snap lock components 226/236 adjacent the opposed ends of the adjoining shunt tubes 230*a-b* and hold the jumper tube 240 connected between the adjoining shunt tubes 230*a-b*.

Again as shown in FIG. 4A, the opposing components with the first snap lock components 236 can be the ends or separate connectors on the adjoining shunt tubes 230*a-b*. In this case, the ends of the shunt tubes 230*a-b* may fit at least partially in or beyond the tube slots 222 in the end rings 220. Alternatively as shown in FIG. 4B, the opposing components with the first snap lock components 226 can be portions of the end rings 220 disposed on the connected wellscreen joints 14*a-b*. In this case, the ends of the shunt tubes 230*a-b* may fit at least partially in the tube slots 222 in the end rings 220.

The first snap lock components 226/236 can be slots defined in the opposing components adjacent the opposed ends of the adjoining shunt tubes 230*a-b*, and the second snap lock components 260 can be tabs having catches for engaging in the slots. Alternatively, the first snap lock components 226/236 can be catches biased toward a locking position, and the second snap lock components 260 can be slots engaging the biased catches in the locking position. Reverse arrangements are also possible.

Figures 5A, 5B, 5C:
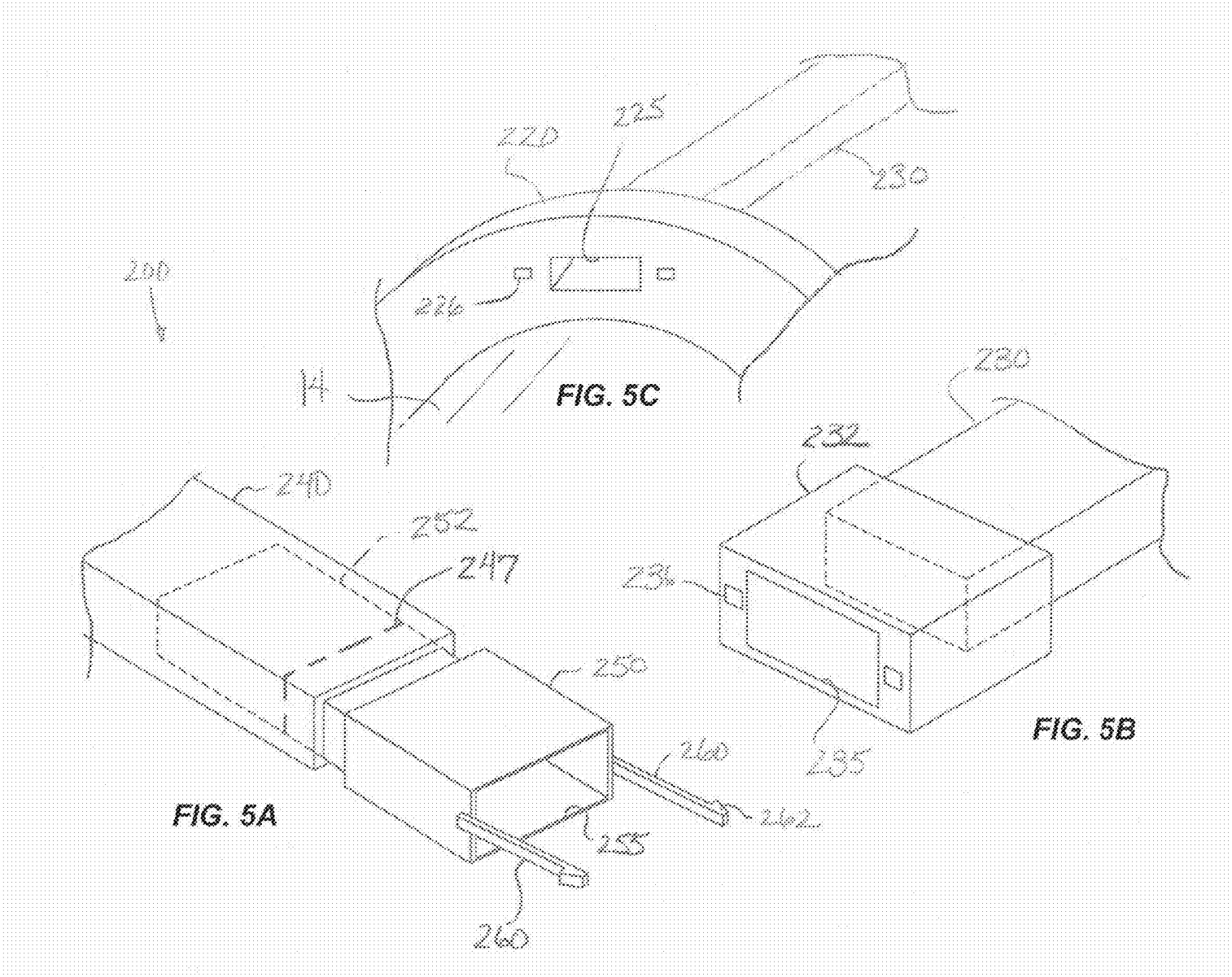
FIG. 5A illustrates a telescopic, clipping shunt tube connection according to the present disclosure for a wellscreen assembly.
FIG. 5B illustrates an end connector on a shunt tube for connection with the shunt tube connection of FIG. 5A.
FIG. 5C illustrates an end ring of a wellscreen assembly having openings for the shunt tube connection of FIG. 5A.

Turning now to FIG. 5A, a telescopic, clipping shunt tube connection 200 according to the present disclosure for a wellscreen assembly is shown in isolated detail. Here, one end of a jumper tube 240 is shown having a jumper connector 250 fit telescopically thereon. The other end of the jumper tube 240 can have a similarly arranged connector 250.

In one arrangement, the jumper connector 250 of FIG. 5A can connect directly to a complimentary connector 232 as shown in FIG. 5B disposed on (i.e., affixed to or formed on) an end of a shunt tube 230. In another arrangement, the jumper connector 250 of FIG. 5A can connect directly to a portion of an end ring 220 as shown in FIG. 5C of a wellscreen assembly having an opening 225 and slots 226 for the jumper connector 250.

In summary, the embodiments of FIGS. 4A-4B and 5A-5C uses a jumper tube 240 featuring jumper connectors 250 on its ends. The jumper connectors 250 are designed to slide onto or into the ends of the jumper tube 240 in a telescoping engagement. When the jumper tube 240 is installed into the gap between the shunt tubes 230*a-b* on adjoining wellscreen joints 14*a-b*, the jumper connectors 250 are driven partially off of the ends of the jumper tube 240 to communicate with the ends of the shunt tube 230*a-b* and form a sealing engagement between both tubes 230 and 240.

As shown in FIG. 5A, the jumper connector 250 can have an end 252 that telescopically connects to the end of the jumper tube 240. Here, the end 252 disposes inside the end of the jumper tube 240, but a reverse arrangement can be used.

A seal 247 is provided to seal the connection between the jumper tube 240 and the connector's end 252. The seal 247 can use O-rings, a bonded seal, or other sealing feature to seal the mating surfaces of the connector end 252 and the jumper tube 240. The end 252 once extended to the desired length to fit the jumper tube 240 between end rings (not shown) can be held by an interference fit, thread, external fastener, or other mechanism (not shown).

To facilitate installation of the jumper tube 240 in the gap G between connected wellscreen joints 14*a-b*, the connection 200 uses the snap lock components described previously that allow for readily connecting the jumper tube 240 between the opposed ends of the shunt tubes 230*a-b*. In particular, the distal end of the connector 250 has a snap lock component 260, which can include latches, locks, or clips extending therefrom beyond the connector's open passage 255. As shown here in FIG. 5A, the components 260 are clips having flexible fingers with wedged lock ends or catches 262.

As disclosed herein, the connectors 250 telescopically connected to the ends of the jumper tube 240 can be moved out relative to the end of the jumper tube 240 to connect the jumper tube 240 with the shunt tubes 230 that runs along the well sections. The clip component 260 on the connector 250 allows the connector 250 to affix in place so that jumper tube 240 can remain connected.

In one embodiment, the connector 250 can connect directly to the end of a shunt tube 230 of an adjacent wellscreen joint 14*a-b*. As shown in FIGS. 4A and 5B, for example, the shunt tube 230*a-b* may be preassembled on the wellscreen joints 14*a-b*, and the distal ends of the shunt tubes 230*a-b* can extend beyond the end rings 220 for connecting to the jumper tube (240) at the joint between wellscreen joints 14*a-b*.

As shown in FIG. 5B, an end connector 232 can be affixed to (or formed on) the end of the shunt tubes 230 using any acceptable mechanism, fasteners, welding, etc. The end connector 232 defines a passage 235 for communicating with the shunt tube 230 and can include a lip, seal, or other feature to seal communication therebetween. The end connector 232 also has a corresponding snap lock component 236 to mate with the connector's component 260. As shown here in FIG. 5B, the snap lock components 236 include catch slots disposed on the face of the end connector 232.

To connect an end of the jumper tube 240 to the ends of the shunt tubes 230*a-b*, operators make up the joints 14*a-b* of the wellscreen assembly, aligning the top and bottom shunt tubes 230*a-b* of the adjoining sections. Then, operators install the jumper connectors 250 on the ends of the jumper tube 240, if the tube 240 is not already preassembled at the well site with such connectors 250. Operators may also install the shunt connectors 232 (FIG. 5B) on the ends of the adjoining shunt tubes 230*a-b*, although these are preferably preassembled.

The end connectors 250 on the ends of the jumper tube 240 can then telescopically extend to mate with the shunt connectors 232 so that the jumper tube 240 and adjoining shunt tubes 230*a-b* can communicate with one another. The connectors 250 and 232 lock together when the catches 262 on the fingers 260 fit inside the lock slots 236 on the end connector 232. The interface between the connectors 250 and 232 can seal fluid communication between one another by a face-to-face seal (not shown). Alternatively, a male feature around the opening 255 or 235 on one of the connectors 250 and 232 can fit and preferably seal inside a female feature around the opening 255 or 235 of the other connectors 250 and 232.

In another embodiment shown in FIGS. 4B and 5C, the end ring 220 of the wellscreen assembly at one or both ends of the adjacent wellscreen joints may have a shunt tube 230*a-b* connected to an opening 225 in the ring 220. Because the shunt tube 230 can be preassembled on the wellscreen section, it can be permanently affixed to the end ring 220. To connect an end of the jumper tube 240 to the end of the shunt tube 230, operators make up the joints aligning the top and bottom shunt tubes 230 of the adjoining sections. Then, operators install the jumper connectors 250 on the ends of the jumper tube 240, if the tube 240 is not already preassembled at the well site with such connectors 250.

The end connector 250 on the end of the jumper tube 240 can then telescopically extend to mate with the end ring 220 so that the jumper tube 240 and adjoining shunt tube 230 can communicate with one another. The connector 250 locks to the end ring 220 when the catches 262 on the fingers 260 fit inside the corresponding snap lock component 226 (e.g., lock slots) on the end ring 220. During assembly, for example, the jumper connector 250 is pulled from the jumper tube 240, and the clips 260 can lock into the end ring 220. As shown, the end ring 220 has the shunt tube 230 attached thereto with an opening 225 for communicating slurry. As shown in FIG. 5C, the apertures 226 defined on either side of the tube's opening 225 can accept the toothed catches 262 of the clips 260 on the end connector 250 of FIG. 5A to make up the connection 200.

The interface between the connector 250 and end ring 220 can seal fluid communication between one another by a face-to-face seal (not shown). Alternatively, a male feature around the opening 255 or 225 on one of the components 250 and 220 can fit and preferably seal inside a female feature around the opening 255 or 225 of the other component 250 and 220.

Figure 6:
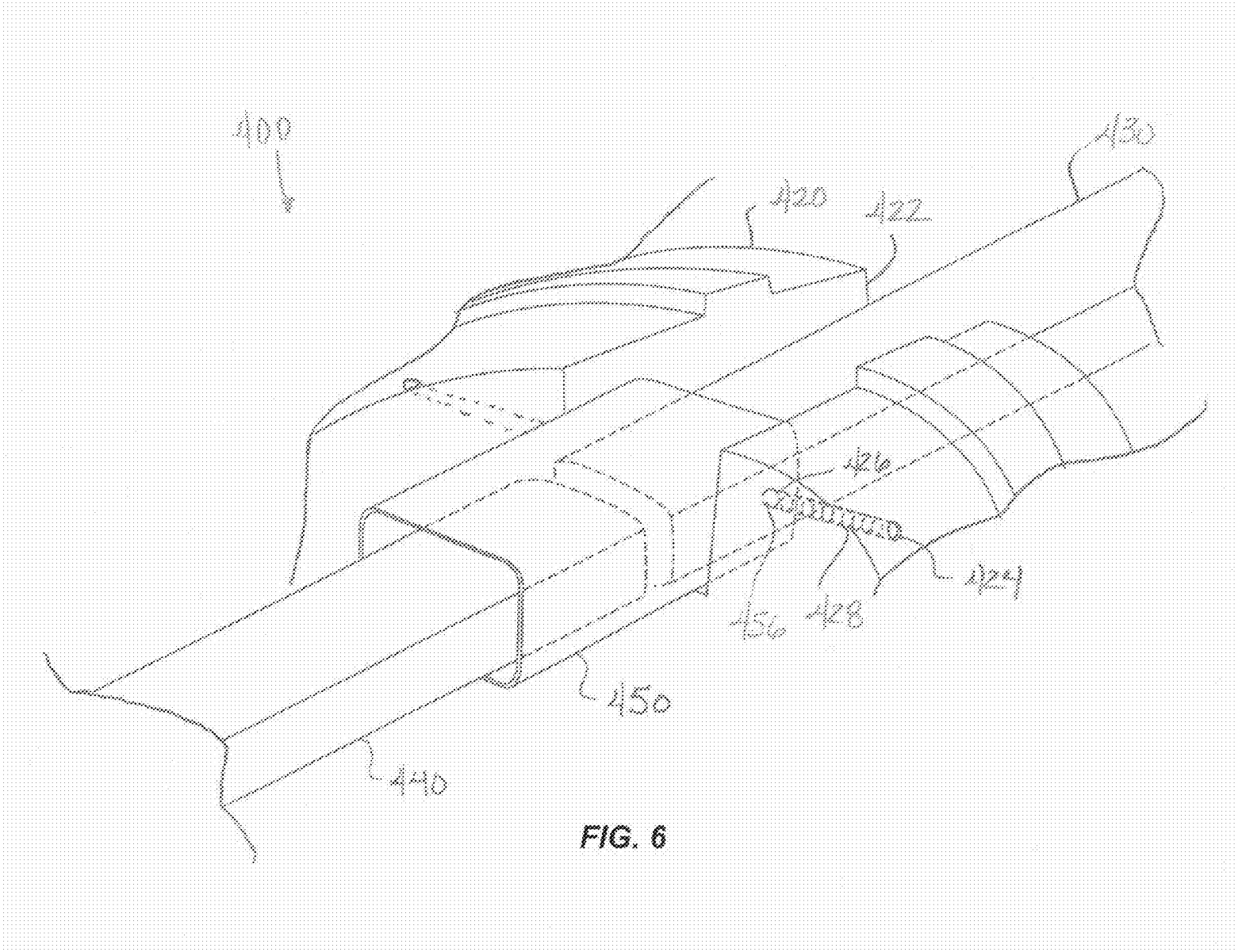
FIG. 6 illustrates a locking shunt tube connection according to the present disclosure for a wellscreen assembly.

FIG. 6 illustrates another locking shunt tube connection 400 according to the present disclosure for a wellscreen assembly. An end ring 420, such as a top or bottom ring, of a wellscreen assembly has a cutaway 422 for connection of a jumper tube 440 to a shunt tube 430. A connector 450 is disposed on the end of the jumper tube 440 and on the end of the shunt tube 430. As is known, the shunt tube 430 runs adjacent the wellscreen of the assembly, and the jumper tube 440 fits between bottom and top end rings 420 at the joint of wellscreen sections. Internal seals, such as O-rings or the like, may be provided inside the connector 450 to seal against the tubes 430 and 440.

The connector 450 positions in the cutaway 420 of the end ring 220. A snap lock component 426 is disposed in a transverse slot 428 in the end ring 420. The lock component 426 extends into the cutaway 422 and engages in a corresponding snap lock component 456 (e.g., slot, indentation, hole, or the like) defined in the connector 450. The ring's lock component 426 can use a spring-loaded or biased catch (e.g., ball, pin, or the like) or can be a threaded pin or the like. A comparable lock component 426 can be provided on the other side of the cutaway 422. Moreover, a reverse arrangement can be used. In particular, the snap lock component 426 on the end connector 450 can be a slot, indentation, hole, or the like defined in the end ring 420, and the other snap lock component 456 can use a spring-loaded or biased catch (e.g., ball, pin, or the like) or can be a threaded pin or the like on the connector 450.

During installation of the wellscreen assembly at the rig, an upper wellscreen joint is joined to a lower wellscreen joint. For example, the joints of the assembly may have timed threads so that the adjoining shunt tubes 430 on the two joints can align with one another. At this point, operators install the jumper tube 440 between the ends of the adjoining shunt tubes 430 at the adjacent end rings 420 of the connected joints. To do this, the jumper tube 440 has the connectors 450 on its ends retracted so that the tube 440 can fit in the gap between the end rings 420. The connectors 450 can then be extended to lock in place in the end rings 420 to communicate the adjoining shunt tubes 430 through the jumper tube 440.

Figures 7A, 7B, 7C:
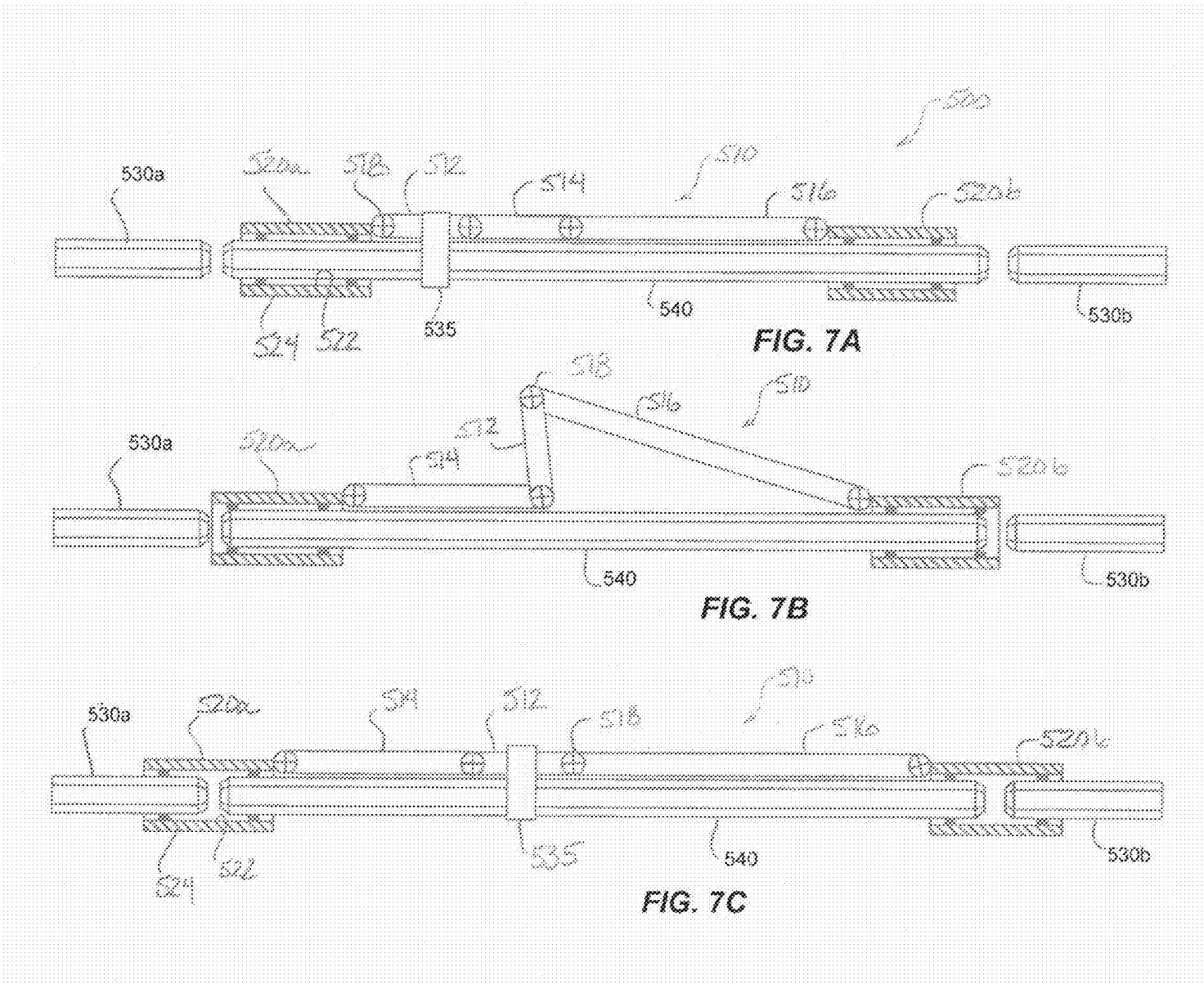
FIGS. 7A-7C illustrate a linked connection according to the present disclosure for connecting a jumper tube to shunt tubes of a wellscreen assembly.

FIGS. 7A-7C illustrate a linked connection 500 according to the present disclosure for connecting a jumper tube 540 to shunt tubes 530*a-b* of adjoining wellscreen sections (not shown). The jumper tube 540 has end connectors 520*a-b* slidably disposed toward both ends of the jumper tube 540.

Internal seals 524, such as O-rings, may be provided on the inside passages 522 of the end connectors 520*a-b* to seal against the jumper tube 540.

A linkage or pivot mechanism 510 interconnects the two end connectors 520*a-b*. In the current embodiment, the linkage mechanism 510 has a plurality (e.g., three) arms 512, 514, and 516 pivotably connected together by pivots 518. Other embodiments of the linkage mechanism 510 may use sliding arms. The jumper tube 540 is assembled with the two end connectors 520*a-b* retracted toward one another in a retracted condition, and the linking arms 512, 514, and 516 are pivoted inward together in a retracted, pivoted condition. A band 535, strap, or other lock feature can lock the linkage mechanism 510 and end connectors 520*a-b* in place for shipping and assembly.

When wellscreen joints are made up, the two ends of the in-line shunt tubes 530*a-b* disposed at the end rings (not shown) are separated from one another. To complete the communication of the in-line shunt tubes 530*a-b*, operators remove the band 535, strap, or the like from the jumper tube 540 and the linkage mechanism 510. The jumper tube 540 is then positioned next to the joint and positioned in-line with the opposing ends of the shunt tubes 530*a-b*. At this point, operators move (e.g., pivot) the various linking arms 512, 514, and 516 on the pivots 518 to extend the end connectors 520*a-b* partially on the ends of the opposing shunt tubes 530*a-b* to an extended condition. As an alternative to fitting on the shunt tubes 530*a-b*, the end connectors 520*a-b* can fit partially inside the shunt tubes 530*a-b* or can engage a portion of the end rings (not shown) to which the shunt tubes 530*a-b* connect.

As noted above, O-rings or other seals 524 inside the end connectors 520*a-b* can engage the ends of the jumper tube 540 and shunt tubes 530*a-b* to seal the communication. Operators can then lock the linking arms 512, 514, and 516 in their extended state using a band 535, strap or the like. Alternatively, one or more of the pivots 518 of the arms 512, 514, and 516 may have integrated locking features so that the arms 512, 514, and 516 pivot in one direction open relative to one another but are locked from pivoting back closed.

A number of types of locks can be used to keep the linkage mechanism in the extended condition, as will be appreciated with the benefit of the present disclosure. Although not preferred, lugs or fasteners can even be used to lock the linking arms 512, 514, and 516 in their extended state. Moreover, any of the various snap lock components and features disclosed herein can be used on the end connectors 520*a-b*, the end rings (not shown), the arms 512, 514 & 516, and the like to sustain the connection 500. In other words, the end connectors 520*a-b* can have snap lock components such as disclosed previous to engage complementary snap lock components disposed on the ends of the shunt tubes 530*a-b* or on portions of the end rings (not shown). These and a number of other alternatives can be used.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A connection for communicating opposed ends of adjoining shunt tubes on connected wellscreen joints, the connection comprising:

a jumper tube having first and second ends;

first and second end connectors disposed on the first and second ends of the jumper tube and movable thereon between extended and retracted conditions; and a linkage connected to the first and second end connectors and operable between first and second conditions, the linkage in the first condition retracting the first and second end connectors to the retracted condition from the first and second ends of the jumper tube, the linkage in the second condition extending the first and second end connectors to the extended condition from the first and second ends of the jumper tube and onto the opposed ends of the adjoining shunt tubes.

2. The connection of claim 1, wherein the linkage comprises a plurality of linking arms connected together by pivots, one end of the linking arms connected to the first end connector, another end of the linking arms connected to the first end connector.

3. The connection of claim 1, wherein each of the first and second end connectors comprises seals engaging the jumper tube and the opposed ends of the adjoining shunt tubes.

4. The connection of claim 1, wherein the linkage comprises a lock locking the linkage in the second condition.

5. The connection of claim 4, wherein the lock comprises a band disposed about linking arms of the linkage.

6. The connection of claim 1, wherein each of the first end second end connectors comprises a tube section disposed externally on the end of the shunt tube.

7. A wellscreen assembly, comprising:

first and second screen joints connected together and having first and second adjoining shunt tubes, the first and second adjoining shunt tubes having opposed ends separated by a gap from one another;

a jumper tube having first and second ends and positioning in the gap between the opposed ends of the adjoining shunt tubes;

first and second end connectors disposed on the first and second ends of the jumper tube and movable thereon between extended and retracted conditions; and a linkage connected to the first and second end connectors and operable between first and second conditions, the linkage in the first condition retracting the first and second end connectors to the retracted condition from the first and second ends of the jumper tube, the linkage in the second condition extending the first and second end connectors to the extended condition from the first and second ends of the jumper tube and onto the opposed ends of the adjoining shunt tubes.

8. The assembly of claim 7, wherein the linkage comprises a plurality of linking arms connected together by pivots, one end of the linking arms connected to the first end connector, another end of the linking arms connected to the first end connector.

9. The assembly of claim 7, wherein each of the first and second end connectors comprises seals engaging the jumper tube and the opposed ends of the adjoining shunt tubes.

10. The assembly of claim 7, wherein the linkage comprises a lock locking the linkage in the second condition.

11. The assembly of claim 10, wherein the lock comprises a band disposed about linking arms of the linkage.

12. The assembly of claim 7, wherein each of the first end second end connectors comprises a tube section disposed externally on the end of the shunt tube.

13. A method of communicating opposed ends of adjoining shunt tubes on connected wellscreen joints, the method comprising:

positioning a jumper tube in a gap between the opposed ends of the adjoining shunt tubes on the connected wellscreen joints;

moving a linkage from a first condition to a second condition;

moving first and second end connectors, disposed on first and second ends of the jumper tube and connected to the linkage, from retracted conditions to extended conditions on the jumper tube; and engaging the first and second end connectors in the extended condition with the opposed ends of the adjoining shunt tubes.

14. The method of claim 13, wherein moving the linkage from the first condition to the second condition comprises pivoting a plurality of linking arms of the linkage connected together by pivots, one end of the linking arms connected to the first end connector, another end of the linking arms connected to the first end connector.

15. The method of claim 13, wherein engaging the first and second end connectors in the extended condition with the opposed ends of the adjoining shunt tubes comprises sealing the engagement of the first and second end connectors with the opposed ends of the adjoining shunt tubes.

16. The method of claim 13, further comprising locking the linkage in the second condition.

17. The method of claim 16, wherein locking the linkage in the second condition comprises positioning a band about linking arms of the linkage.

18. The method of claim 13, wherein engaging the first and second end connectors in the extended condition with the opposed ends of the adjoining shunt tubes comprises positioning tube sections of the first and second end connectors externally on the opposed ends of the adjoining shunt tubes.

19. An apparatus for communicating adjoining shunt tubes, the assembly comprising:

a jumper tube having first and second ends;

first and second end connectors disposed on the first and second ends of the jumper tube and movable thereon between extended and retracted conditions; and a linkage connected to the first and second end connectors and operable between first and second conditions, the linkage in the first condition retracting the first and second end connectors to the retracted condition from the first and second ends of the jumper tube, the linkage in the second condition extending the first and second end connectors to the extended condition from the first and second ends of the jumper tube, the first and second end connectors in the extended condition placing the jumper tube in communication with the adjoining shunt tubes.

20. The apparatus of claim 19, wherein the linkage comprises a plurality of linking arms connected together by pivots, one end of the linking arms connected to the first end connector, another end of the linking arms connected to the first end connector.

21. The apparatus of claim 19, wherein each of the first and second end connectors comprises seals engaging the jumper tube and the adjoining shunt tubes.

22. The apparatus of claim 19, wherein the linkage comprises a lock locking the linkage in the second condition.

23. The apparatus of claim 22, wherein the lock comprises a band disposed about linking arms of the linkage.

24. The apparatus of claim 19, wherein each of the first and second end connectors comprises a tube section disposed on the end of the jumper tube.

25. The apparatus of claim 24, wherein the tube sections of the first and second end connectors are telescopically disposed on the first and second ends of the jumper tube.

26. The apparatus of claim 19, comprising means for engaging the first and second end connectors in the extended condition with the adjoining shunt tubes.

27. The apparatus of claim 19, the first and second end connectors in the extended condition couple to opposed ends of the adjoining shunt tubes.

28. The apparatus of claim 19, comprising first and second screen joints connected together and having the first and second adjoining shunt tubes.

* * * * *